United States Patent [19]

Sasaki

[11] Patent Number: 4,919,193

[45] Date of Patent: Apr. 24, 1990

[54] MOLD CORE FOR INVESTMENT CASTING, PROCESS FOR PREPARING THE SAME AND PROCESS FOR PREPARING MOLD FOR INVESTMENT CASTING HAVING THEREWITHIN SAID MOLD CORE

[76] Inventor: Nobuyoshi Sasaki, 18-3, 1-chome, Aobadai, Midori-ku, Yokohama-shi, Kanagawa-ken, Japan

[21] Appl. No.: 332,445

[22] Filed: Mar. 31, 1989

Related U.S. Application Data

[63] Continuation of Ser. No. 225,625, Jul. 27, 1988, abandoned, which is a continuation of Ser. No. 936,123, Dec. 1, 1986, abandoned.

[30] Foreign Application Priority Data

Aug. 14, 1986 [JP] Japan ..... 61-189593

[51] Int. Cl.[5] ..... B22C 9/04

[52] U.S. Cl. ..... 164/516; 164/35; 164/138

[58] Field of Search ..... 164/14, 15, 23, 24, 164/28, 33, 34, 35, 138, 365, 369, 512–519, 520, 525, 528; 427/134, 154, 416, 443

[56] References Cited

U.S. PATENT DOCUMENTS

| | | | |
|---|---|---|---|
| 3,981,344 | 9/1976 | Hayes et al. | 164/516 |
| 4,001,468 | 1/1977 | Skubon et al. | 427/134 |
| 4,529,028 | 7/1985 | Dybala et al. | 164/14 |

FOREIGN PATENT DOCUMENTS

| | | | |
|---|---|---|---|
| 2132536 | 1/1973 | Fed. Rep. of Germany | 164/520 |
| 57-152344 | 9/1982 | Japan | 164/138 |
| 61-48481 | 3/1986 | Japan | 427/443 |

*Primary Examiner*—Richard K. Seidel

*Attorney, Agent, or Firm*—Laff, Whitesel, Conte & Saret

[57] ABSTRACT

A core mold to be assembled with a shell mold for use in an investment casting process is provided. The core mold comprises a core matrix essentially consisting of an aggregate and an inorganic binder, a binder layer impregnated from the surface of said core matrix, a coating layer formed by coating a slurry over said binder layer, and a paraffin wax layer covering the exterior periphery of said coating layer. Also provided are a process for preparing the core mold and a process for preparing an investment casting mold in which the core mold is assembled.

1 Claim, 3 Drawing Sheets

MOLD CORE FOR INVESTMENT CASTING, PROCESS FOR PREPARING THE SAME AND PROCESS FOR PREPARING MOLD FOR INVESTMENT CASTING HAVING THEREWITHIN SAID MOLD CORE

This is a continuation of application Ser. No. 225,625 filed July 27, 1988 now abandoned which is a continuation of application Ser. No. 936,123 filed Dec. 1, 1986 now abandoned.

BACKGROUND OF THE INVENTION

1. Field of the Invention

The present invention relates to a mold core used in an investment casting process and a process for preparing such a mold core, and further pertains to a process for preparing a mold for an investment molding process used with such a mold core.

2. Related Art Statement

A ceramic mold core used or assembled within a mold for an investment casting process should have a sufficiently smooth surface, a strength which is high enough to withstand the injection molding of a wax model and having a strength at high temperatures which is sufficient for retaining its integrity under high temperature environment, during the sintering and/or casting steps. Prior art cores conventionally used for such purposes are molded from aggregates, such as those containing alumina, zirconium or fused silica. Then the thus molded cores are burned or sintered singly. However, such a process leads to a low producibility or operation efficiency. In addition, it leads to the problem that the dimensional accuracy of the finished core is inferior, particularly in a preparation of a large size core, with extreme difficulty for obtaining a large-size core of accurate dimensions as well as an increase in production cost.

Further disadvantages of conventional sintered core molds are that they are hard to demolish after use. They cannot be removed from the casting by the application of physical vibrations or impact. Thus, cumbersome and inefficient operations are required for the removal of such cores.

In addition, in the production of such core molds which should be sintered for acquiring the necessary strength and integrity, some of the inexpensive aggregates, such as silinceous sand, cannot be used as the starting materials because of the difficulty encountered in sintering them.

OBJECTS AND SUMMARY OF THE INVENTION

An object of this invention is to provide a mold core having a smooth surface which is suited for molding a wax model and having a strength which is high enough to withstand the injection molding operation during the step of molding the wax model and a thermal strength which is sufficient to withstand a high temperature during the mold baking step and the molten metal casting step.

Another object of this invention is to provide a mold core which can be prepared at a high production efficiency and at a low cost and which can be used without being sintered so that it is demolished by physical means in order to be removed easily after use.

A further object of this invention is to provide a mold core which is prepared from inexpensive silliceous sand.

According to a second aspect of this invention, there is provided a process for preparing such a mold core.

According to a third aspect of this invention, there is provided a process for preparing a mold for investment casting.

With the aforementioned objects in view, the mold core provided in accordance with this invention comprises a core matrix essentially consisting of an aggregate and an inorganic binder, a binder layer impregnated from the surface of said core matrix, a coating layer formed by coating a slurry over said binder layer, and a paraffin wax layer covering the exterior periphery of said coating layer.

The process for preparing a mold core, provided in accordance with the second aspect of this invention, comprises the steps of:

(a) kneading an aggregate with an inorganic binder;

(b) casting the kneaded aggregate and inorganic binder into a core molding mold to be solidified therein to produce a core matrix;

(c) dipping the solidified core matrix in a binder bath so that the core matrix is impregnated with the binder from the surface thereof;

(d) coating the core matrix impregnated with the binder with a slurry followed by drying to form a coating layer; and (e) covering said coating layer with paraffin wax.

The process for preparing an investment casting mold, provided in accordance with the third aspect of this invention comprises the steps of:

(a) kneading an aggregate with an inorganic binder;

(b) casting the kneaded aggregate and inorganic binder into a core molding mold to be solidified therein to produce a core matrix;

(c) dipping the solidified core matrix in a binder bath so that the core matrix is impregnated with the binder from the surface thereof;

(d) coating the core matrix impregnated by said step(c) with a slurry followed by drying to form a coating layer;

(e) covering said coating layer with paraffin wax to produce a core mold;

(f) placing said core mold in position within a shell mold and then pouring a lost model forming material into said shell mold to produce a lost model having therewithin said core mold;

(g) coating a slurry and stucco particles alternately for plural times to form a refractory layer which is then dried;

(h) allowing said lost model to vanish so as to obtain a final mold; and (i) baking said core mold and said refractory layer simultaneously.

DESCRIPTION OF PREFERRED EMBODIMENT

Figure 1:
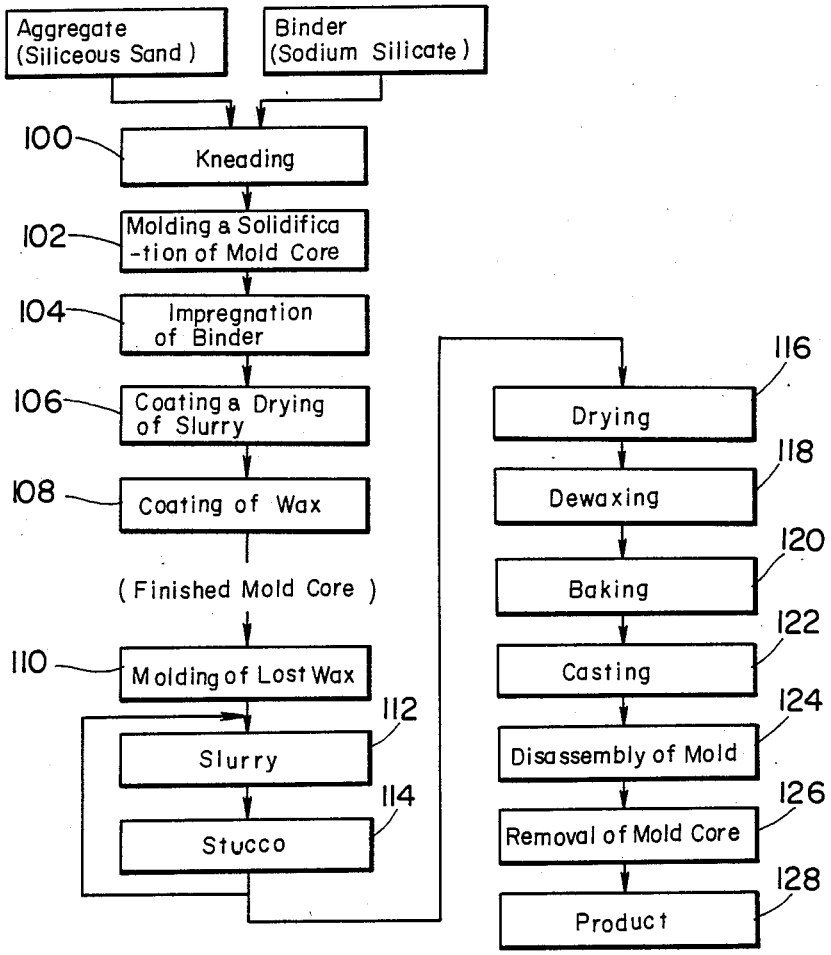
FIG. 1 is a flow diagram showing the process for preparing a mold core according to this invention.
Figure 2:
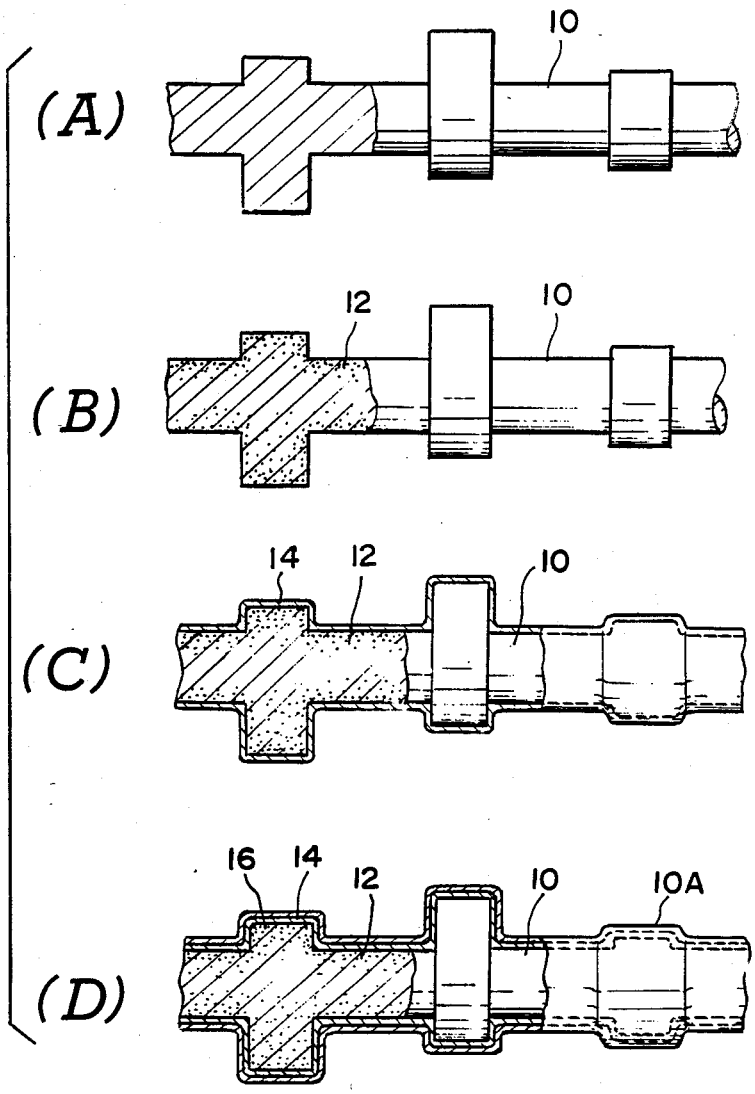
FIGS. 2(A) to 2(G) are illustrations showing the steps of preparing a mold core of this invention and the steps of investment casting process wherein the thus prepared mold core is used.
Figure 2:
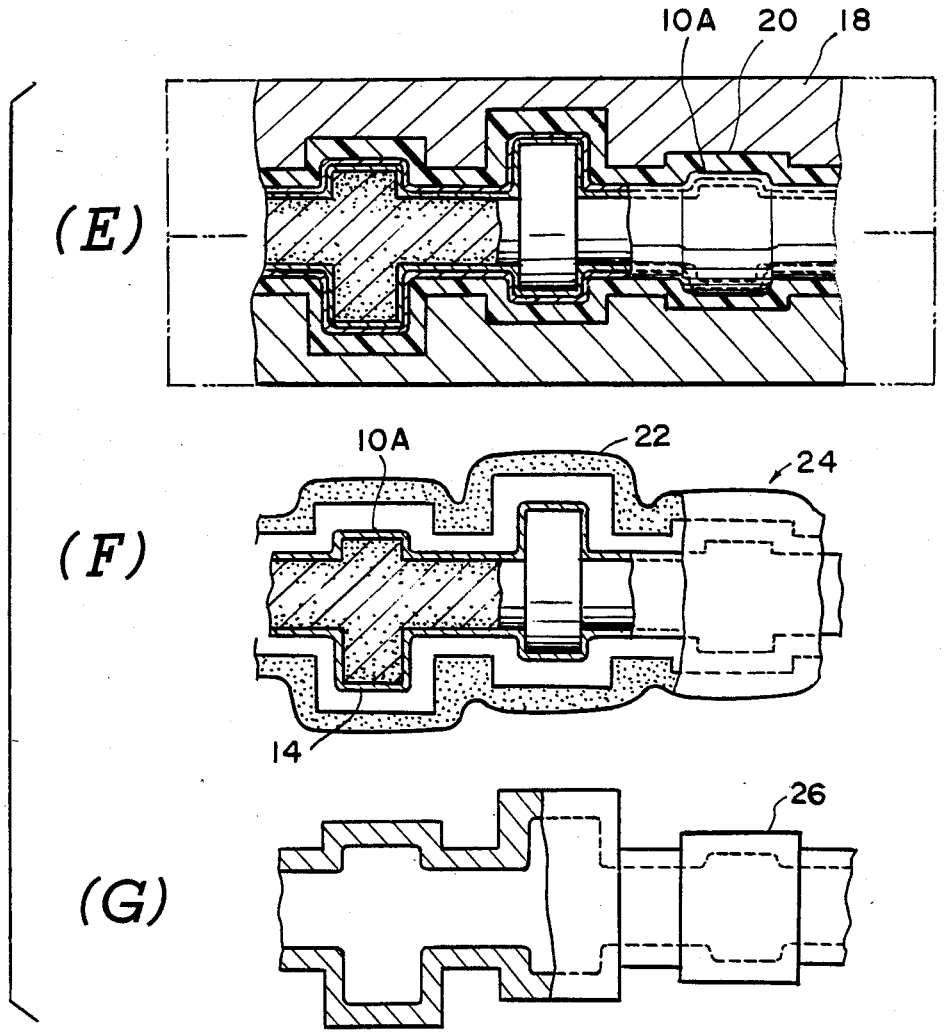

An embodiment of this invention will be described with referene to FIGS. 1 and 2 showing the steps of the process for preparing the mold core of this invention.

At the first step, an aggregate and an inorganic binder are kneaded together. One example of the aggregate which may be used in this invention has the following composition of:

Siliceous Sand: 75–100 wt%

Silica Flour: 0–25 wt%

Preferably 90 wt% of siliceous sand and 10 wt% of silica flour may be used. Preferable siliceous sand used in the composition has a particle size corresponding to #7 grade stipulated in JIS G-5901(1954).

An example of a preferable inorganic binder is JIS #3 sodium silicate (water glass), which is added little by little to the main ingredient, i.e. the siliceous sand, in an amount of about 5 to 15 wt%, preferably about 8 to 10 wt%, based on the total weight of the aggregate, followed by kneading (Step 100).

Preferably, kneading is effected at a room temperature of about 20° C. and at a relative humidity of about 55% for about 20 minutes, and immediately after the completion of the kneading operation, the container is sealed to prevent the kneaded mass from being hardened due to the reaction of sodium silicate with carbon dioxide in the atmosphere.

The kneaded aggregate mixture is fed in a mold (not shown) for shaping a mold core so that a core matrix 10 (see FIG. 2(A) is prepared. In this step, hot air (at about 140° to 150° C.) is blown into the mold to facilitate solidification of the core matrix 10. Otherwise, the core matrix 10 may be solidified through the $CO_2$ process wherein a core matrix is molded using a wooden mold heated to 60° to 80° C. and then carbon dioxide gas is blown through the blow holes or the slits at the splitting surfaces of the mold to solidify the core matrix contained in the wooden mold. Due to the binding force of the hardened inorganic binder, the thus prepared core matrix has a strength and integrity for retaining its shape and dimensions during the later wax model injection molding step.

The next step is the step of dipping the core matrix 10 into a bath containing a binder so that the surface of the core matrix 10 is covered with the layer 12 impregnated with the binder (Step 104 in FIG. 1; FIG. 2(B)). Examples of a preferable binder used in this step are ethyl silicate and colloidal silica. Such a binder impregnates from the surface of the core matrix 10 to a proper depth for increasing the strength of the core matrix at a high temperature environment. The solidified aggregate added with sodium silicate and then solidified at the preceding steps 100 and 102 has a sufficient strength at a temperature of up to about 200° C., but the strength of the aggregate bonded by the hardened sodium silicate is abruptly lowered as the temperature is raised above 200° C. The core matrix impregnated with the binder at the step 104 has a strength which is high enough for retaining its integrity, within a temperature range of from 200° to 1000° C.

The core matrix impregnated with the binder is coated with a slurry (Step 106; FIG. 2(C)) which desirously contains a binder and a filler. An example of the slurry used in this step 106 has the following composition of:

Ethyl silicate (Binder): 50 wt%

Zircon Flour #350 (Filler): 50 wt%

The slurry may be coated by the dipping process wherein the core matrix 10 is dipped into a slurry container, or by the spraying method wherein the slurry is sprayed onto the surface of the core matrix, or by the electrostatic coating method wherein an electrostatic potential is applied between the core matrix 10 and a sprayer nozzle to deposite the slurry mists onto the surface of the core matrix 10. For instance, when the slurry is coated by the dipping process, the core matrix 10 is dipped in the slurry container for about 60 seconds. Prior to coating with the slurry at the step 106, the core matrix 10 impregnated with the binder may be dried to form the layer.

A coating layer 14 is thus formed by coating the slurry over the surface of the binder containing layer 12. The surface condition of the core matrix 10 is improved by the provision of the coating layer 14 to give a smooth surface. The mold reaction between the mold and the molten metal at the casting step is also improved by the provision of such a coating layer 14, with a further advantage that the high temperature strength of the mold core is further increased. After being coated with the slurry, the mold core matrix is then dried, for example, at a temperature of 28° C. and at a relative humidity of 50%, by air flowing at a rate of 1 m/sec for about 3 hours. A large size core may be additionally dried by microwave heating for about 10 minutes.

The dried core matrix 10 is then coated with paraffin wax (Step 108; FIG. 2(D)). The core matrix 10 coated with the coating layer 14 is dipped in a molten paraffin wax maintained at 80° to 90° C. for about 10 minutes to form a wax layer 16 over the surface of the coating layer 14 so that the crumbling or fall-off of the coating layer 14 is prevented. The wax layer 16 also serves to increase the strength of the core to prevent a breakdown thereof during the transportation operation and to prevent the core from absorbing moisure during the storage time.

The finished mold core 10A shown in FIG. 2(D) is prepared through the aforementioned steps of impregnating the core matrix 10 with the binder to form a binder containing layer 12, and then forming successively the coating layer 14 and the wax layer 16 over the exterior surface of the layer 12.

The mold core 10A is fixed in position by any conventional means within a shell mold 18. A material for forming a lost model, such as a wax or foamed polystyrene, is injected into the cavity defined by the core 10A and the shell mold 18, whereby a lost model 20 is molded (Step 110; FIG. 2(E)). The lost model 20 is then removed from the shell mold 18 and a refractory material is coated over the periphery of the lost model 20 by repeating for plurality of times the operation cycle each including the step of dipping the lost model in a slurry container (Step 112) and the step of applying with stucco particles (Step 114), whereby a refractory material layer 22 having a desired thickness is formed (FIG. 2(F)). After sufficiently drying the refractory material layer 22 (Step 116), the lost wax model 20 is allowed to vanish by dewaxing (Step 118). Then, the refractory material layer 22 is baked (Step 120). During this dexaxing step, the wax layer 16 of the core 10A is also removed, whereupon the coating layer 14 is exposed over the surface of the core 10A. At the baking step (Step 120), the core 10A deprived of the wax layer 16 is also baked simultaneously with the baking of the refractory material layer 22 of the shell mold. As a result of the aforementioned sequential operations, a ceramic shell mold 24 is produced containing therein the core matrix 10 having a layer 12 impregnated with the binder and being covered with the coating layer 14 (see FIG. 2(F)).

A molten metal is cast into the cavity of the ceramic shell mold 24, i.e. the cavity defined by the interior wall of the refractory material layer 22 of the shell mold 24 and the exterior surface of the coating layer 14 of the mold core 10A (step 122). After cooling, the outside shell mold is removed (Step 124) and then the core matrix 10 and the coating layer 14 are removed (Step 126). The core matrix 10 and the coating layer 14 are removed by the step of removing the major portion of the core by means of physical vibration or impact. The subsequent step is immersing the cast metal in a caustic soda solution or hot melt caustic soda to dissolve the remaining portions of the core matrix and the coating layer. A final cast product 26 is thus produced as shown in FIG. 2(G). An important advantage of the process of the invention is that the core matrix may be readily demolished to be removed easily at the step 126, since the depth of the layer 12 impregnated with the binder is spontaneously controlled to an appropriate degree so that the central portion of the core matrix 10 is not impregnated with the binder.

Although the core matrix 10 has the binder and the slurry which is applied by the separate steps 104 and 106, respectively for impregnating with the binder (Step 104) and for coating with the slurry (Step 106) in the aforementioned embodiment, the steps 104 and 106 may be combined to treat the core matrix 10 at a single step. This may be done by using a slurry containing the same binder that is used in the step 104 and by increasing the time for dipping the core matrix in the slurry container to allow the binder to be impregnated into the core matrix to a desired depth.

Although the present invention has been described by referring to an embodiment wherein the mold core prepared by the invention is combined with a ceramic shell mold, it should be apparent to those skilled in the art that the mold core of the invention may also be conveniently used in other investment casting process, such as solid mold process.

The aggregate and the binder which may be used in the present invention should not be limited only to the materials specifically referred to in the aforementioned embodiment. For example, siliceous sand used as the aggregate may be replaced in part or entirely by alumina, fused silica, zircon or fused mullite. Phosphate cement may be used as the inorganic binder added to and kneaded with the aggregate.

The mold core provided by the present invention has a strength for withstanding the injection molding operation for molding a wax model, and also has a strength which is sufficient at the high temperature environments which are encountered during the mold baking step and the molten metal casting step without the need of sintering the mold core prior to its combination with the outside shell mold. Due to exclusion of the step of sintering the mold core, the total process can be simplified to improve production efficiency and to lower the cost, with an additional merit that the dimensions of the mold core may be more easily controlled. It is also possible to prepare a mold core made of materials which are the same as the materials used in the outside shell mold so that the core mold and the shell mold have essentially the same thermal expansion coefficient, to accurately control the dimensions of the finished cast product. This is particularly convenient when a large-scale cast product is produced.

According to another important feature of this invention, the impregnation of the binder into the core matrix is limited to an appropriate depth so that the mold core can be readily demolished or collapsed and thus easily removed after use.

The coating layer serves to smooth the rough surface of the shaped core matrix and to suppress the mold reaction taking place between the molten metal and the mold core at the later casting step to prevent formation of rough surface of the cast product. The strength of the mold core at the high temperature environments during the baking step and the casting step is further increased by the provision of the coating layer, so that the yield rate of the total casting process is improved.

The wax layer prevents a fall-off of the coating layer and to increase the strength of the mold core so that breakdown of the core during the transportation is prevented, and also prevents the mold core from absorbing moisture during the storage time.

What is claimed is:

1. A process for preparing an investment casting mold in which molten metal is thereafter cast; said process comprising the steps of:

(a) kneading an aggregate with a first inorganic binder for increasing the strength and integrity of said aggregate for withstanding an injection molding operation for molding a lost model;

(b) molding the kneaded aggregate and first inorganic binder into a core molding mold to be solidified therein to produce a core matrix;

(c) dipping the solidified core matrix in a second inorganic binder bath so that the core matrix is impregnated with the second inorganic binder penetrating from the surface into a marginal portion of the body thereof, said second inorganic binder layer increasing the strength of said core matrix at a high temperature environment which is reached during a mold baking step and thereafter during a molten metal casting step;

(d) coating the core matrix impregnated by said step (c) with a slurry followed by drying to form a coating layer;

(e) covering said coating layer with paraffin wax to produce a core mold;

(f) placing said core mold in position within a shell mold and then pouring a lost model forming material into said shell mold to produce a lost model having therewithin said core mold;

(g) alternately coating a slurry and layer of stucco particles for a plurality of times to form a refractory layer which is then dried;

(h) allowing said lost model to vanish so as to obtain a final mold; and (i) baking said core mold and said refractory layer simultaneously.

* * * * *